United States Patent [19]

Huether

[11] Patent Number: 4,645,421

[45] Date of Patent: Feb. 24, 1987

[54] HYBRID VANE OR BLADE FOR A FLUID FLOW ENGINE

[75] Inventor: Werner Huether, Karlsfeld, Fed. Rep. of Germany

[73] Assignee: MTU Motoren-und Turbinen-Union Muenchen GmbH, Munich, Fed. Rep. of Germany

[21] Appl. No.: 869,575

[22] Filed: Jun. 2, 1986

[30] Foreign Application Priority Data

Jun. 19, 1985 [DE] Fed. Rep. of Germany ..... 3521782

[51] Int. Cl.[4] ..... F01D 5/18

[52] U.S. Cl. ..... 416/92; 416/96 A; 416/241 B

[58] Field of Search ..... 416/241 B, 92, 96 A

[56] References Cited

U.S. PATENT DOCUMENTS

| | | | |
|---|---|---|---|
| 4,247,259 | 1/1981 | Saboe et al. | 416/241 B |
| 4,285,634 | 8/1981 | Rossman et al. | 416/241 B X |
| 4,480,956 | 11/1984 | Kruger et al. | 416/241 B X |
| 4,512,719 | 4/1985 | Rossmann | 416/241 B |
| 4,519,745 | 5/1985 | Rosman et al. | 416/241 B X |
| 4,563,125 | 1/1986 | Boudigues et al. | 416/241 B X |
| 4,563,128 | 1/1986 | Rossmann | 416/241 B X |

FOREIGN PATENT DOCUMENTS

| | | | |
|---|---|---|---|
| 2834843 | 6/1980 | Fed. Rep. of Germany . | |
| 2834864 | 11/1981 | Fed. Rep. of Germany . | |
| 3110096 | 9/1982 | Fed. Rep. of Germany | 416/241 B |
| 56147 | 9/1952 | France | 416/241 B |
| 57426 | 1/1953 | France | 416/241 B |
| 2463849 | 4/1981 | France | 416/96 A |
| 380391 | 5/1940 | Italy | 416/241 B |
| 2027496 | 2/1980 | United Kingdom | 416/241 B |

*Primary Examiner*—Everette A. Powell, Jr.

*Attorney, Agent, or Firm*—W. G. Fasse; D. H. Kane, Jr.

[57] ABSTRACT

A hybrid blade for a fluid flow engine has a U-shaped core of metal or a metal alloy and a ceramic outer jacket which forms together with a mounting plate a unitary, single piece structure. The legs of the core straddle the mounting plate and a heat insulating member is inserted between a crosspiece of the core and the mounting plate. This structure permits relative movement between the core and the jacket to compensate for different heat expansion coefficients.

20 Claims, 7 Drawing Figures

HYBRID VANE OR BLADE FOR A FLUID FLOW ENGINE

FIELD OF THE INVENTION

The invention relates to a hybrid vane or blade made of metal and ceramics, especially for a fluid flow engine. These blades may form the guide vanes in the stator or the moving blades of a rotor in a fluid flow engine, whereby the material having the higher temperature resistance forms an outer core.

DESCRIPTION OF THE PRIOR ART

Blades or vanes of the above type are known in the art, for example, from German Patent Publication (DE-OS) No. 2,834,843, from German Patent (DE-PS) No. 2,834,864, and from German Patent Publication (DE-OS) No. 3,110,096. The last mentioned German Patent Publication, for example, discloses a blade with a metallic core surrounded by a ceramic blade jacket connected to the metallic core by a ceramic pin passing through the core and connected to the core.

These ceramic pins in prior art structures are subject to stress peaks which increase the break-down danger of such prior art blade or vane structures of the hybrid type. The breaking danger in prior art structures is primarily due to the different heat expansions of the ceramic jacket and the metallic core, whereby the breaking tends to occur in the respective zone where the two components contact each other. Breaking also is due to the fact that the zone of contact between the inner and outer components comprises an inner circumferential bead which results in a relatively small core cross-section. Another reason for the breaking of prior art blade structures of this type is seen in the small contact surface area in the ceramic jacket and in the fact that a precise machining of this contact area is most difficult.

OBJECTS OF THE INVENTION

In view of the foregoing it is the aim of the invention to achieve the following objects singly or in combination:

to construct a hybrid blade in such a way that the different thermal expansion coefficients of the metallic core and the ceramic jacket are reduced to avoid the above causes for breaking;

to take into account the different characteristics of metals and metal alloys as well as the different characteristics of ceramics when using these materials for manufacturing such hybrid blades;

to provide a blade construction which permits a large core cross-section while simultaneously avoiding local stress peaks in the ceramic jacket;

to provide such a blade construction that the core component or components as well as the jacket are easily machined for the intended purpose.

SUMMARY OF THE INVENTION

The fluid flow engine blade of the invention has a foot, a jacket, a mounting member, and a core. The jacket and mounting member or plate are constructed as an integral, one piece unit. The core has a U-shape which is inserted into the jacket so that the mounting plate sits between the legs of the U-shaped core whereby the free or first ends of the legs of the U-shaped core are anchored in the foot of the blade. An insulating member is inserted between the mounting plate and the inner surface of a crosspiece of the U-shaped core connecting the second leg ends.

The important advantage of the invention is seen in that the ceramic components are subject to compression loads in the transition area between metal and ceramic components. This transition area is relatively small so that any heat expansion is well controlled to avoid the danger of breaking. Further, the heat transfer from the jacket to the core is reduced and both, the core and the jacket, are easily machinable.

The blade foot and the core are made of metal, whereby so-called super alloys, nickel base alloys, titanium base alloys, and other alloys may be used for making the blade foot and the core.

The outer jacket is made of ceramics, especially fiber reinforced ceramics, whereby the fibers can be silicon carbide (SiC) fibers and the ceramic embedding or matrix material may also be silicon carbide. Another suitable material is silicon nitride ($Si_3N_4$) forming a matrix material for silicon carbide fibers embedded in the $Si_3N_4$ to form the jacket. Carbon fibers embedded in carbon material are also suitable to form the jacket which is then preferably provided with a silicon carbide protective coating.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
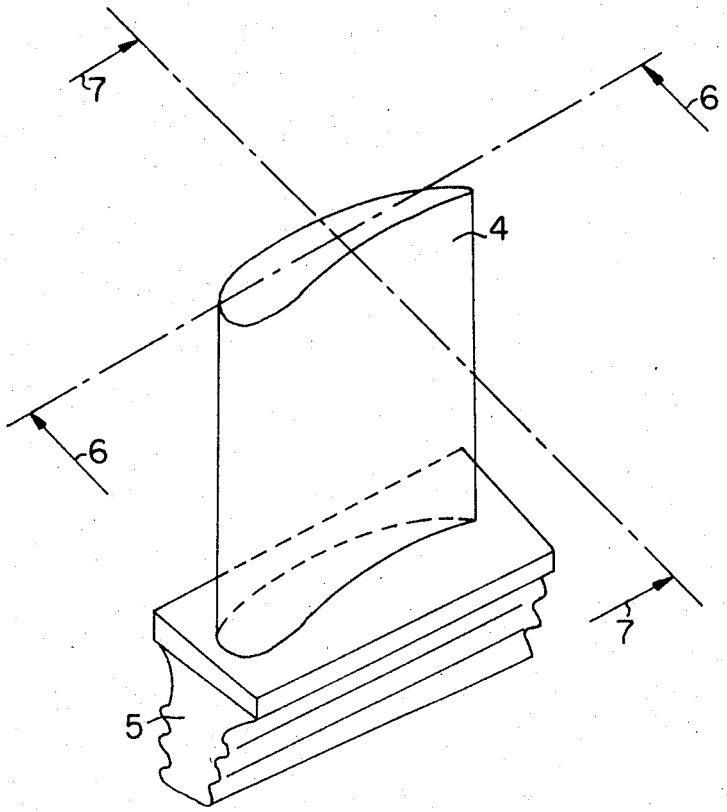
FIG. 1 illustrates a perspective view of the hybrid blade according to the invention for showing the sectional planes of FIGS. 6 and 7.
Figure 2:
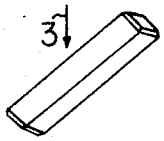
FIG. 2 shows a perspective view of an insulating member forming an intermediate bearing between the mounting plate of the jacket and the U-shaped core.
Figure 3:
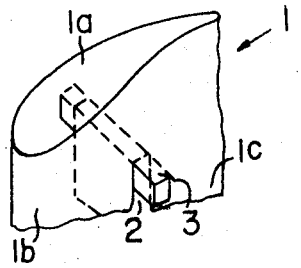
FIG. 3 shows a broken-away perspective view of the core according to the invention.
Figure 4:
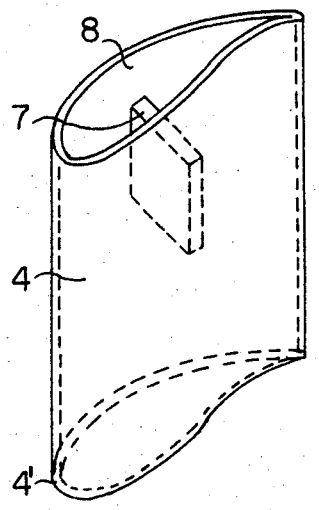
FIG. 4 shows a perspective view of the jacket with its integral core mounting plate according to the invention.
Figure 5:
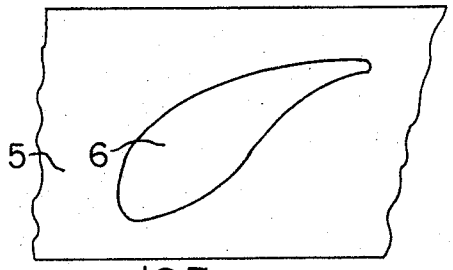
FIG. 5 is a top plan view, partially broken away, of the blade foot.
Figure 6:
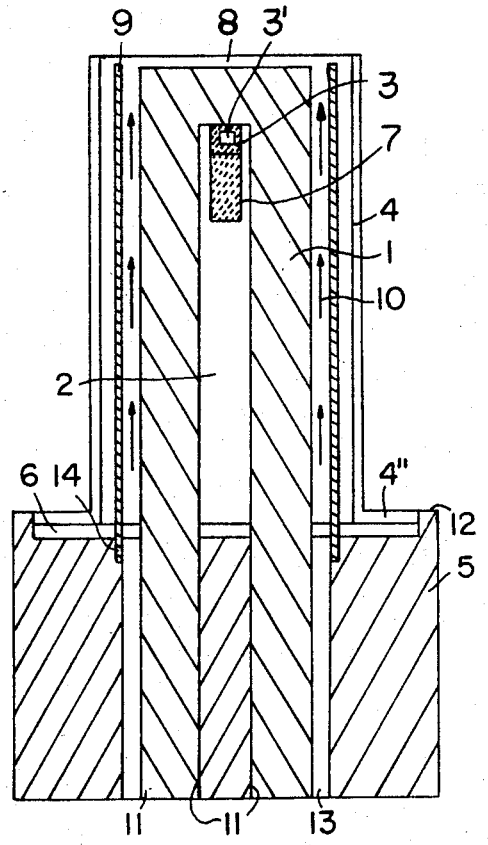
FIG. 6 is a sectional view along section line 6—6 in FIG. 1.
Figure 7:
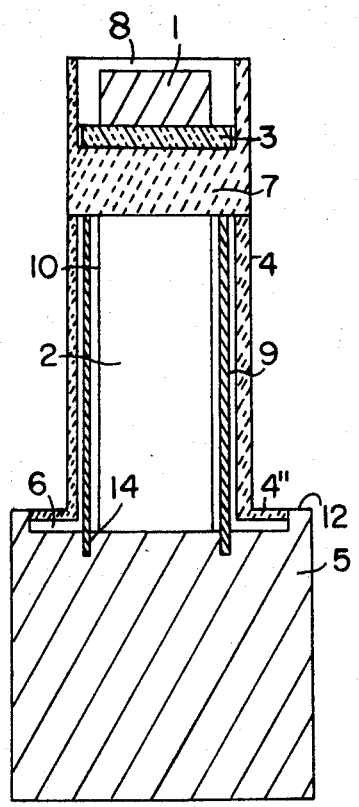
FIG. 7 is a sectional view along section line 7—7 in FIG. 1.

FIG. 1 shows the blade jacket 4 conventionally secured to a blade foot 5. The particular mounting according to the invention of the core 1, shown in FIG. 3, is not visible in FIG. 1. The insulating member 3 shown in FIG. 2 is inserted into a slot 2 between the legs **1*b* and 1*c* interconnected by a crosspiece 1*a* of the core 1 as shown in FIG. 3 and as also illustrated in FIGS. 6 and 7. The core 1 has a U-shape formed by the crosspiece 1*a* and legs 1*b*, 1*c* extending longitudinally inside the jacket 4 shown in FIG. 4. For this purpose the jacket 4 encloses a hollow space 8 in which a mounting pin or mounting plate 7 is formed as an integral component of the jacket 4 to form a single piece structure. The lower end 4' of the jacket 4 fits into a respectively shaped recess 6 in the foot 5 as shown in FIG. 5. The securing of the lower end 4' of the jacket 4 in the recess 6** is accomplished by conventional means such as brazing and is not part of the invention. The mounting pin or plate 7 fits with a sliding fit into a slot 2 between the legs 1*b* and 1*c* of the core 1.

The foot 5 shown in FIG. 5 may, for example, have a dove-tail cross-sectional configuration, or it may have an inverted christmas tree type cross-sectional configuration as shown in FIG. 1. The free ends of the legs 1*b* and 1*c* of the core 1 are also anchored in the foot by conventional means such as soldering or brazing. The blade foot 5 is preferably made of metal or a metal alloy which may be the same or similar to the metal of which the core 1 is made. Preferably, the blade foot 5 may be made by conventional erosion techniques using a solid blank as the starting material. However, the blade foot 5 may also be manufactured by conventional precision casting techniques.

The jacket 4 is made of a ceramic material having a high temperature resistance. The jacket 4 is preferably produced by an injection molding technique using a silicon carbide material (SiC) or a silicon nitride material ($Si_3N_4$) which are capable of being sintered. Another method of producing the jacket 4 with its mounting plate 7 as an integral component employs an isostatic cold pressing of a ceramic powder in a mold with a core. The so pressed blank is then machined into a shape which is almost finished. A final machining, such as grinding, may involve providing the mounting plate 7 with parallel surfaces for a precise sliding fit in the slot 2. The machining of the pressed blank takes place before any sintering.

The core 1 produced, for example as mentioned above by a precision casting method, may be subjected to a final precision polishing or grinding. Similarly, a core produced by an eroding technique could be ground especially on its surfaces where it rides on the insulating member 3. The core 1 may also be produced as a single crystal by a directed solidification following a casting operation. The slot 2 may be conventionally produced by a milling operation and, as mentioned, the surfaces contacting the insulating member 3 and the mounting plate 7 are preferably ground to a proper sliding fit. Any finishing operation suitable for producing smooth parallel surfaces may be used. It is necessary to assure an easy relative movement between the jacket 4 and the core 1 to compensate for different heat expansions during operation. The parallelness of the surfaces facing one another should be smaller, for example, than 0.5 micrometer.

The insulating member 3 is preferably made of a ceramic material having a high temperature resistance such as a partially stabilized zirconium oxide or a combination of zirconium and yttrium oxides ($CrO_2$ and $Y_2O_3$).

The hybrid blade according to the invention is assembled as follows. First, the insulating member 3 is placed on top of the mounting plate 7 of the jacket 4. Then the U-shaped core 1 is axially inserted into the jacket 4 so that the inner surface of crosspiece 1*a* comes to rest on the insulating member 3, whereby the latter is held between the core and the mounting plate 7. Thus, the insulating member 3 is prevented from falling out of the blade. Then the jacket 4 and the core 1 are held together and the lower end 4′ or 4″ of the core 4 is inserted into the recess 6 in the blade foot 5. Thereafter, the core 1 and the foot 5 are rigidly interconnected with each other by conventional means such as a brazing 11 shown in FIG. 6 at the bottom of the foot 5. In other words, the brazing is performed at the foot surface opposite the recess 6 in which the flange 4″ of the jacket 4 is also held, for example, by a brazing 12.

FIGS. 6 and 7 further show a cooling air channel 13 through which cooling air is flowing as indicated by the arrows 10. Additionally, a cooling air guide baffle 9 may be inserted into the space between the core 1 and the jacket 4. The guide baffle 9 is anchored in the foot 5 as shown at 14 and forms a protection shield against heat radiation.

Rather than shaping the core 1 as shown, it could have a conical shape tapering toward the upper end of the jacket 4. This feature results in a weight reduction and in reduced stress at the core end opposite to the blade foot 5.

Incidentally, the cooling air channel 13 which extends through the foot 5 as best seen in FIG. 6, opens into the hollow space 8 inside the jacket 4, thus providing a continuous cooling air flow from a wheel hub and/or a turbine rotor. The jacket 4 may also be cooled by air 10 flowing through the cooling air channel 13 by leaving a space below the flange 4″ also as best seen in FIGS. 6 and 7.

The guide baffle 9 may simultaneously serve as a radiation protecting shield for the core 1, thereby retarding any heat transmission from the jacket 4 to the core 1. The guide baffle 9 does not contact the jacket 4 nor does it contact the core 1, thus providing a spacing toward the jacket and toward the core. The anchoring 14 of the guide baffle 9 in the foot 5 may also be accomplished by brazing or soldering.

Incidentally, the insulating member 3, forming a bearing between the crosspiece 1*a* and the mounting plate 7, may be hollow as shown at 3′ in FIG. 6, for an improved heat dissipation.

Although the invention has been described with reference to specific example embodiments, it will be appreciated, that it is intended to cover all modifications and equivalents within the scope of the appended claims.

What I claim is:

1. A blade for a fluid flow engine, comprising a blade foot, a ceramic hollow blade jacket having one end secured to said blade foot, a metallic blade core having a U-shaped configuration and including a crosspiece and legs spaced by a gap, said legs having first ends rigidly anchored to said blade foot and second ends interconnected by said crosspiece, a mounting member in said hollow jacket, said mounting member and said hollow jacket forming an integral one-piece unit, said legs and crosspiece of said U-shaped blade core straddling said mounting member, so that said blade core can be inserted into said hollow blade jacket in the direction of a longitudinal blade axis, and a heat insulating member interposed between said crosspiece and said mounting member for forming an intermediate bearing between said crosspiece and said mounting member, whereby said blade core can move independently of said blade jacket for compensating for different temperature coefficients of said blade jacket and of said blade core.

2. The blade of claim 1, wherein said heat insulating member inserted between said crosspiece and said mounting member, is a precision finished, especially ground member with parallel surfaces for contacting said blade core to provide an easy slide fit.

3. The blade of claim 1, wherein said blade core legs comprise a soldered or brazed connection to said blade foot.

4. The blade of claim 1, wherein said blade core is made of metal, a metal alloy, a super alloy, or the like.

5. The blade of claim 4, wherein said blade core is a precision cast component, especially with a directed solidification after the casting.

6. The blade of claim 4, wherein said blade core is a single crystal.

7. The blade of claim 1, wherein said jacket is made of a fiber reinforced ceramic material having a high temperature resistance, said ceramic material including, for example, fiber reinforced silicon carbide or fiber reinforced silicon nitride.

8. The blade of claim 7, wherein the jacket is an injection molded component.

9. The blade of claim 1, wherein the jacket is made of a high temperature resistant ceramic powder, especially silicon carbide powder or silicon nitride powder.

10. The blade of claim 9, wherein the jacket is formed by cold isostatic compression and is then machined before any sintering.

11. The blade of claim 1, wherein said insulating member is a member of partially stabilized zirconium oxide, all contact surfaces of which are ground, preferably precision ground.

12. The blade of claim 1, wherein said blade core has a conical shape tapering from said blade foot to a blade tip.

13. The blade of claim 1, comprising a radiation protecting shield between said blade core and said blade jacket, whereby said protection shield is spaced from said blade jacket.

14. The blade of claim 13, comprising a cooling air channel formed between said blade core and said protection shield forming a guide baffle for cooling air, whereby said blade core is coolable.

15. The blade of claim 14, wherein said blade core comprises longitudinally extending through-going cooling channels.

16. The blade of claim 1, wherein said gap between the legs of said blade core for receiving said insulating member and said mounting member of said blade jacket, has a larger width and a substantially larger length or depth than said insulating member and than said mounting member.

17. The blade of claim 1, wherein said mounting member has a rectangular cross-section which extends upright in said gap.

18. The blade of claim 1, wherein said insulating member rests on said mounting member in the assembled state in a sliding or push fit.

19. The blade of claim 1, wherein said insulating member between said blade core crosspiece and said blade jacket has a block form with a square cross-sectional configuration.

20. The blade of claim 1, wherein said block is hollow for an improved heat insulation.

* * * * *